US007260941B2

(12) United States Patent
van Hasselt

(10) Patent No.: US 7,260,941 B2
(45) Date of Patent: Aug. 28, 2007

(54) SUPERCONDUCTOR DEVICE HAVING SUPERCONDUCTIVE MAGNET AND REFRIGERATION UNIT

(75) Inventor: Peter van Hasselt, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 197 days.

(21) Appl. No.: 10/514,428

(22) PCT Filed: Apr. 29, 2003

(86) PCT No.: PCT/DE03/01378

§ 371 (c)(1),
(2), (4) Date: Nov. 15, 2004

(87) PCT Pub. No.: WO03/098645

PCT Pub. Date: Nov. 27, 2003

(65) Prior Publication Data

US 2005/0252219 A1 Nov. 17, 2005

(30) Foreign Application Priority Data

May 15, 2002 (DE) ..... 102 21 639

(51) Int. Cl.
*F25B 9/00* (2006.01)
*F28D 15/00* (2006.01)

(52) U.S. Cl. ..... 62/6; 165/104.21

(58) Field of Classification Search ..... 62/6, 62/51.1; 165/104.21
See application file for complete search history.

(56) References Cited

U.S. PATENT DOCUMENTS 4,380,712 A * 4/1983 Intichar et al. ..... 310/52
4,726,199 A 2/1988 Takano et al.
4,771,824 A * 9/1988 Rojey et al. ..... 165/104.13
4,790,147 A 12/1988 Kuriyama et al.
4,995,450 A 2/1991 Geppelt et al.
5,070,702 A 12/1991 Jackson
5,193,349 A * 3/1993 Laverman et al. ..... 62/64
5,363,078 A 11/1994 Ries et al.
5,485,730 A 1/1996 Herd
6,186,755 B1 * 2/2001 Haga ..... 418/55.1
6,246,308 B1 6/2001 Laskaris et al.
6,376,943 B1 * 4/2002 Gamble et al. ..... 310/52

(Continued)

FOREIGN PATENT DOCUMENTS

DE 37 39070 5/1988

(Continued)

OTHER PUBLICATIONS

J. Kazunori et al., "A Cryocooler Cooled 10.7T Superconducting Magnet with a Room Temperature Bore of 52mm", Proceedings of the Sixteenth International Cryogenic Engineering Conference/ International Cryogenic Materials Conference, Part 1, May 20-24 1996, pp. 1109-1132.

(Continued)

*Primary Examiner*—William C. Doerrler
(74) *Attorney, Agent, or Firm*—Staas & Halsey LLP

(57) ABSTRACT

A superconducting magnet with at least one cooling agent-free superconducting coil is provided along with a cooling unit with at least one cold head. A conduit system, thermally coupling the coil to the cold head, includes at least one duct in which a cooling agent circulates according to a thermo-syphon effect.

10 Claims, 2 Drawing Sheets

U.S. PATENT DOCUMENTS

| | | | | |
|---|---|---|---|---|
| 6,783,059 | B2 | 8/2004 | Laskaris et al. | |
| 6,812,601 | B2 * | 11/2004 | Gamble et al. | 310/52 |
| 2004/0056541 | A1 * | 3/2004 | Steinmeyer | 310/52 |
| 2006/0158059 | A1 * | 7/2006 | Steinmeyer et al. | 310/261 |

FOREIGN PATENT DOCUMENTS

| | | |
|---|---|---|
| DE | 198 13 211 | 10/1999 |
| DE | 100 18 169 | 10/2001 |
| EP | 0 616 230 | 9/1994 |
| JP | 58-62055 U | 4/1983 |
| JP | 62-166473 | 10/1987 |

OTHER PUBLICATIONS

Patent Abstracts of Japan for Japanese Patent Application 6-342721, Dec. 13, 1995.

Japanese Patent Office Decision of Rejection, mailed Feb. 15, 2007, and issued in corresponding Japanese Patent Application No. 2004-506048.

* cited by examiner

SUPERCONDUCTOR DEVICE HAVING SUPERCONDUCTIVE MAGNET AND REFRIGERATION UNIT

CROSS REFERENCE TO RELATED APPLICATIONS

This application is based on and hereby claims priority to German Application No. PCT/DE03/01378 filed on 27 Nov. 2003, the contents of which are hereby incorporated by reference.

BACKGROUND OF THE INVENTION

1. Field of the Invention

The invention relates to a superconductor device having a magnet which contains at least one superconductive winding and a refrigeration unit which has at least one cold head.

2. Description of the Related Art

Corresponding superconductor devices are known, for example, from "Proc. 16th Int. Cryog. Engng. Conf. [ICEC 16]", Kitakyushu, J P, 20. May 24, 1996, Verlag Elsevier Science, 1997, pages 1109 to 1132.

In addition to metallic superconductor materials such as NbTi or $Nb_3Sn$, which have been known for a very long time and have very low critical temperatures $T_c$, and which are therefore also referred to as low-$T_c$ superconductor materials or LTC materials, metal-oxide superconductor materials with critical temperatures $T_c$ above 77 K have been known since 1987. The latter materials are also referred to as high-$T_c$ superconductor materials or HTC materials.

Attempts have also been made to produce superconductive metal magnet windings with conductors using such HTC materials. Because their current carrying capacity in magnetic fields has until now been relatively poor, in particular with inductions in the Tesla range, the conductors of such windings are often nevertheless kept at a temperature below 77 K, for example between 10 and 50 K, despite the intrinsically high critical temperatures $T_c$ of the materials used, in order in this way to make it possible to carry significant currents with relatively strong field strengths, for example of several Tesla.

Refrigeration units in the form of so-called cryogenic coolers with a closed helium compressed gas circuit are preferably used to cool windings with HTC conductors in the stated temperature range. Cryogenic coolers such as these are, in particular, of the Gifford-McMahon or Stirling type, or are in the form of so-called pulse tube coolers. Refrigeration units of this type furthermore have the advantage that the refrigeration power is effectively available at the push of a button, so that there is no need for the user to handle cryogenic liquids. When using refrigeration units such as these, a superconductive magnet coil winding, for example, is cooled indirectly only by thermal conduction to a cold head of a refrigerator, that is to say without any refrigerant (see also the cited text reference ICEC 16).

At the moment, superconductive magnet systems, in particular MRI (magnetic resonance imaging) installations, are generally cooled by bath cooling, in the case of helium-cooled magnets (see U.S. Pat. No. 6,246,308 B1). A comparatively large amount of liquid helium, for example several hundred liters, has to be stored for this purpose. This amount of liquid helium leads to an undesirable buildup of pressure in a cryostat that is required when the magnet is quenched, that is to say during the transition from the parts of its winding initially being superconductive to the normally conductive state.

For LTC magnets, refrigerator cooling systems have already been produced using highly thermally conductive connections, for example in the form of copper tubes, which may also possibly be flexible, between a cold head of an appropriate refrigeration unit, and the superconductive winding of the magnet (see the cited literature reference from ICEC 16, in particular pages 1113 to 1116). Depending on the distance between the cold head and the object to be cooled, the large cross sections which are required for good thermal coupling then, however, lead to a considerable enlargement of the cold mass. Particularly in the case of magnet systems with a large physical extent, as are normally used for MRI applications, this is disadvantageous because of the extended cooling-down times.

Instead of thermal coupling such as this of the at least one winding to the at least one cold head via thermally conductive solid bodies, it is also possible to provide a line system in which a helium gas flow circulates (see, for example, U.S. Pat. No. 5,485,730).

SUMMARY OF THE INVENTION

An object of the present invention is to specify a superconductor device having a magnet which contains at least one superconductive winding without any refrigerant, having a refrigeration unit which has at least one cold head, and having thermal coupling of the at least one winding to the at least one cold head, in which the complexity for cooling a superconductive winding is reduced.

The thermal coupling should accordingly be formed between the at least one winding and the at least one cold head should accordingly be in the form of a line system having at least one pipeline for a refrigerant which circulates in it on the basis of a thermosiphon effect. In this context, a cold head is any desired cold surface of a refrigeration unit via which the refrigeration power is emitted directly or indirectly to the refrigerant.

One such line system has at least one closed pipeline, which runs with a gradient between the cold head and the superconductive winding. The gradient at least in some parts of the pipeline is in this case generally more than 0.5°, preferably more than 1°, with respect to the horizontal. The refrigerant located in this pipeline recondenses on a cold surface of the refrigeration unit or of the cold head, and is passed from there to the region of the superconductive winding, where it is heated, and is in general vaporized in the process. The refrigerant vaporized in this way then flows back again within the pipeline to the region of the cold surface of the cold head. The corresponding circulation of the refrigerant accordingly takes place on the basis of the so-called "thermosiphon effect".

The use of a thermosiphon such as this (as a corresponding line system is also referred to) for transmission of the refrigeration power to the winding considerably reduces the amount of cryogenic refrigerant that has to be circulated in comparison to bath cooling, for example by a factor of about 100. Since, furthermore, the liquid circulates only in pipelines with a comparatively small diameter, which is in general in the order of magnitude of a few centimeters, the pressure buildup in the event of quenching can be coped with technically without any problems. In addition to the safety aspects, the reduction in the amount of liquid refrigerant in the system, particularly when using helium or neon as refrigerant, also has a considerable cost advantage. In comparison to cooling using thermally conductive connecting bodies, a thermosiphon also offers the advantage of good thermal coupling irrespective of the physical distance between the cold head and the object to be cooled.

By way of example, the line system may, in particular, have two or more pipelines which are filled with different refrigerants with a different condensation temperature. Appropriately graduated operating temperatures, for example for initial cooling, virtually continuous thermal coupling or virtually continuous thermal coupling by overlapping operating temperature ranges of the refrigerant are thus possible, depending on the requirement for the application. The subsystems may in this case be thermally coupled either to a common cold head or else to separate cold heads of a refrigeration unit.

It is particularly advantageous for the superconductive magnet in the device to contain a winding made of superconductive HTC material and, in particular, also to be kept at a temperature below 77 K. A superconductor device according to the invention may of course, however, also be designed for LTC magnets.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1:
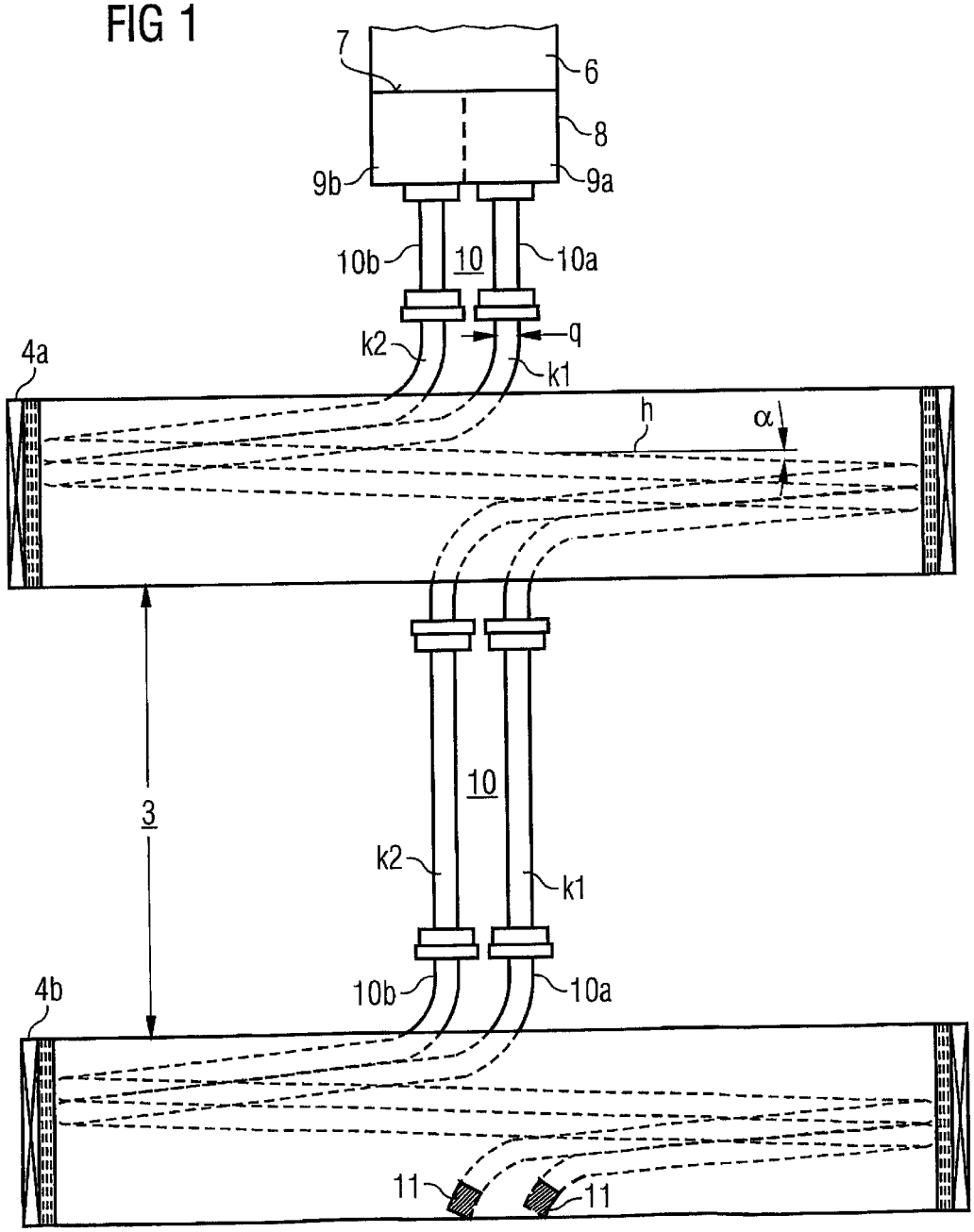
FIG. 1 is a plan view of an MRI magnet with two windings.

Reference will now be made in detail to the preferred embodiments of the present invention, examples of which are illustrated in the accompanying drawings, wherein like reference numerals refer to like elements throughout.

The superconductor device which is annotated in general by 2 in FIG. 1 and of which only those details which are significant to the invention are illustrated may, in particular, be part of an MRI magnet installation. In this case, this is based on embodiments which are known per se with a so-called C magnet (see, for example, DE 198 13 211 C2 or EP 0 616 230 A1). This installation therefore contains a preferably superconductive magnet 3, which will not be described in any more detail, with an upper superconductive winding 4*a*, lying on a horizontal plane, and a lower superconductive winding 4*b*, arranged parallel to the upper winding 4*a*. These windings may, in particular, be produced using conductors composed of high-$T_c$ superconductor material such as $(Bi,Pb)_2Sr_2Ca_2Cu_3O_x$, which may be kept at an operating temperature below 77 K for reasons associated with a high current carrying capacity. The windings are annular and are each accommodated in an appropriate vacuum housing, which is not illustrated.

The refrigeration power for cooling the windings 4*a* and 4*b* is provided by a refrigeration unit, which is not illustrated in any more detail and has at least one cold head 6 located at its cold end. This cold head has a cold surface 7, which must be kept at a predetermined temperature level, or is thermally connected to such a cold surface 7. The interior of a condenser chamber 8 is thermally coupled to this cold surface; for example with the cold surface 7 forming a wall of this area. According to the illustrated exemplary embodiment, the interior of this condenser chamber 8 is subdivided into two subareas 9*a* and 9*b*. A pipeline 10*a* of a pipeline system 10 is connected to the (first) subarea 9*a*. This pipeline first of all passes through the subarea 9*a* into the region of the superconductive winding 4*a*, where it makes good thermally conductive contact with the winding. For example, the pipeline 10*a* passes along the inner face of the winding, in the form of spiral turns. It is not essential for it to be fitted to the inner face; the only important factor is that the pipeline reaches the entire circumference of the winding with a permanent gradient, where it is thermally highly coupled to the parts or conductors of the winding to be cooled. At least the most important parts of the pipeline 10*a* include a gradient (or inclination) angle $\alpha$ of more than 0.5°, preferably of more than 1°, with the horizontal h. For example, the gradient angle $\alpha$ in the region of the-winding 4*a* is thus about 3°. The pipeline 10*a* then leads into the region of the lower winding 4*b*, where it is arranged in a corresponding manner, and is closed at its end 11. The cross section q, which holds the refrigerant k1, of the pipeline 10*a* can advantageously be kept small and, in particular, may be less than 10 $cm^2$. In the illustrated exemplary embodiment, q is about 2 $cm^2$.

The pipeline 10*a*, which is laid with a gradient, contains a first refrigerant k1, for example neon (Ne). The refrigerant k1 in this case circulates in the pipeline 10*a* including the subarea 9*a*, which is connected to it, on the basis of the thermosiphon effect, which is known per se. In the process, the refrigerant condenses in the subarea 9*a* on the cold surface 7, and is passed in liquid form into the region of the superconductive winding, where it is heated, for example at least partially being vaporized, and flows in the pipeline 10*a* back into the subarea 9*a*, where it is recondensed.

According to the illustrated exemplary embodiment, the line system 10 has a second pipeline 10*b*, which is routed parallel to the first pipeline 10*a* and is filled with a further refrigerant k2. This refrigerant is not the same as the first refrigerant k1, that is to say it has a different, preferably higher, condensation temperature. By way of example, nitrogen ($N_2$) may be chosen for the refrigerant k2. The pipeline 10*b* is in this case connected to the (second) subarea 9*b* of the condenser chamber 8. The second refrigerant k2 in this case likewise circulates in the closed pipeline 10*b* and in the subarea 9*b* on the basis of the thermosiphon effect. When the magnet windings are being cooled down, the second refrigerant k2 condenses first of all, in which case the windings may be precooled to about 70 to 80 K, for example by the use of $N_2$ as the refrigerant k2. As the cold surface 7 cools down further, the first refrigerant k1, which is located in the pipeline 10*a*, then condenses at the comparatively lower condensation temperature, thus leading to further cooling down to the intended operating temperature of, for example, 20 K (when neon is used as the first refrigerant k1). The second refrigerant k2 may be frozen in the region of the subarea 9*b* at this operating temperature.

In contrast to the exemplary embodiment illustrated in FIG. 1, the superconductor device 2 according to the invention may, of course, also have only one line system with only a single pipeline. If a greater number of pipelines are envisaged, then two or more pipelines may also be thermally coupled to separate cold heads or to stages of a refrigeration unit at different temperature levels. In the case of two-stage refrigeration units or cold heads, as are planned in particular for cooling thermal plates, the magnet windings—in addition to being thermally linked to the second stage—would also be coupled to the first (warmer) stage for more rapid precooling by a further thermosiphon pipeline which, for example, is filled with nitrogen or argon.

Figure 2:
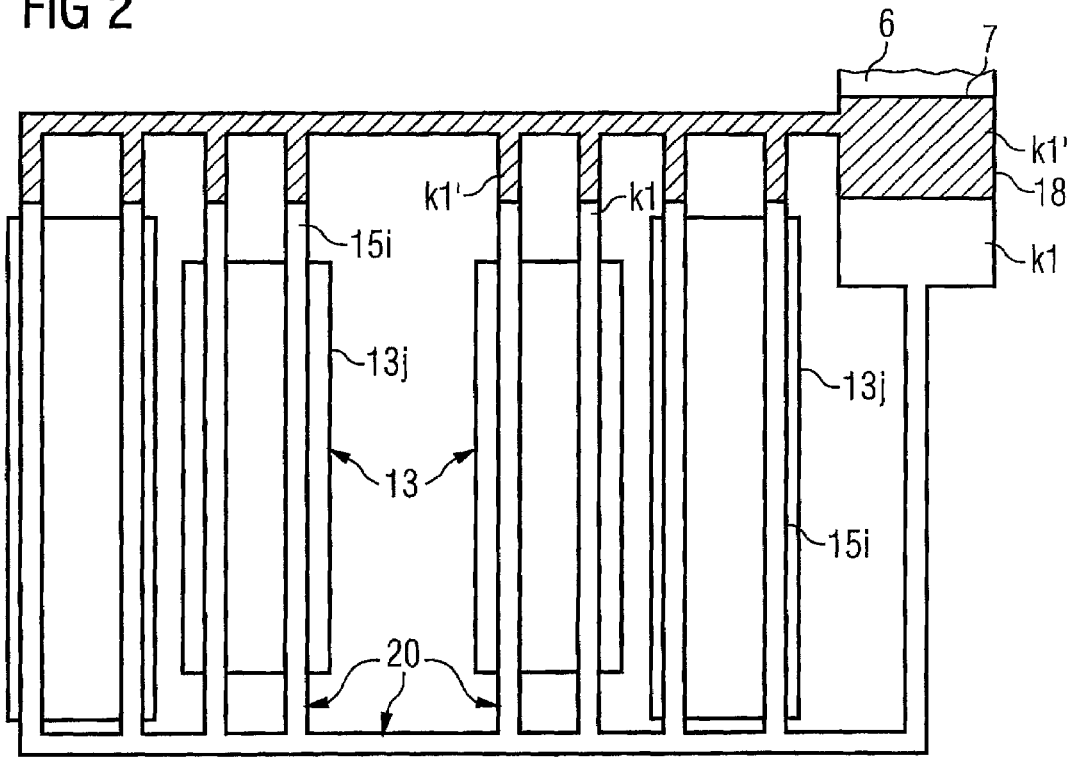
FIG. 2 is a plan view of a different MRI magnet with four windings.

The thermosiphon cooling described above may also, of course, be used for magnets which have vertically arranged windings. One exemplary embodiment of a device according to the invention with corresponding windings is illustrated in FIG. 2. The device, which is annotated generally by 12, contains a superconductive magnet 13 in the form of a solenoid which, by way of example, has four superconductive windings 14*j* (where j=1 . . . 4) located one behind the other in the axial direction. The individual windings are in this case, for example, each cooled on two end faces via pipelines 15*i* (where i=1 . . . 8) which run at least substantially vertically and are filled, for example, with a refrigerant k1. Thus, in this case, there is no need for the spiral shape as in the exemplary embodiment shown in FIG. 1, and the gradient angle $\alpha$ is approximately 90° over large parts of the line system, which is annotated generally by 20. A condenser chamber 18 and a cold head are in general arranged above the windings, in order in this way to ensure the necessary gradient. At least one pipeline 15*i* is required per winding since, in contrast to horizontally arranged windings, one pipeline cannot reach all the windings while maintaining the gradient.

In order to ensure that each pipeline 15*i* receives sufficient recondensed refrigerant k1, the entire pipeline system 20 formed by the pipelines 15*i* must either be in the form of a system of communicating pipes and be completely flooded with the liquid refrigerant in the region of the windings 14*j*. This is illustrated in FIG. 2 by a blacker coloring of the refrigerant k1, while the vaporized refrigerant is shown in a lighter color, and is annotated k1'. Alternatively, each pipeline 15*i* must have a separate condenser (partial) chamber on the cold head.

A line system with pipelines which run parallel and are filled with different refrigerants (k1 and k2) may, of course, also be provided for the embodiment of the device 12 according to the invention illustrated in FIG. 2.

In contrast to the illustrated exemplary embodiments, a superconductor device according to the invention may have a line system with at least one pipeline in which there is also a mixture of two refrigerants with different condensation temperatures. In this case, the gas with the highest condensation temperature can in consequence condense first of all during a gradual cooling-down process, and can form a closed circuit for heat transmission to a winding that is to be cooled. After precooling of this winding down to the triple-point temperature of this gas, this will then freeze in the region of the condenser chamber, following which the other gas mixture component with the lower condensation temperature ensures the rest of the cooling down process to the operating temperature.

Depending on the desired operating temperature, the gases He, $H_2$, Ne, $O_2$, $N_2$, Ar as well as various hydrocarbons may in practice be used as a refrigerant. The respective refrigerant gas is chosen such that the refrigerant is gaseous and liquid at the same time at the intended operating temperature. This makes it possible to ensure circulation on the basis of the thermosiphon effect. The line system may have hot and/or cold equalization containers in order to specifically adjust the amount of refrigerant, while at the same time limiting the system pressure.

The choice of the refrigerant also, of course, depends on the superconductor material used. Only helium may be used as the refrigerant for an LTC material such as $Nb_3Sn$.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in *Superguide v. DIRECTV,* 69 USPQ2d 1865 (Fed. Cir. 2004).

The invention claimed is:

1. A superconductor device, comprising:

a stationary magnet with at least one superconductive winding not in direct contact with any refrigerant;

a refrigeration unit with at least one cold head; and a line system, having at least one pipeline that is closed at its end for refrigerant circulating based on a thermosiphon effect, providing thermal coupling of the at least one superconductive winding to the at least one cold head, wherein said line system has two pipelines files with different refrigerant having different condensation temperatures.

2. The device as claimed in claim 1, wherein the pipelines are thermally coupled to a common cold head.

3. The device as claimed in claim 1, wherein the pipelines are thermally coupled to separate cold heads.

4. The device as claimed in claim 1, wherein at least parts of the at least one pipeline have a gradient with respect to the horizontal of more than 0.5°.

5. The device as claimed in claim 4, wherein the at least parts of the at least one pipeline have a gradient with respect to the horizontal of more than 1°.

6. The device as claimed in claim 1, wherein the cross section of the at least one pipeline carrying the refrigerant is less than 10 $cm^2$.

7. The device as claimed in claim 1, wherein the superconductive winding contains high-$T_c$ superconductor material.

8. The device as claimed in claim 7, wherein the superconductive material must be kept at a temperature below 77K.

9. The device as claimed in claim 1, wherein a mixture of at least two refrigerant components with different condensation temperatures is provided as the refrigerant.

10. The device as claimed in claim 1, wherein the superconductive magnet is part of an MRI installation.

* * * * *